US006159136A

United States Patent [19]

Belias et al.

[11] Patent Number: 6,159,136

[45] Date of Patent: Dec. 12, 2000

[54] EASY TO OPEN HANDLE BAG AND METHOD OF MAKING THE SAME

[75] Inventors: William P. Belias, Pittsford; Michael L. Bohn, Rochester; Clifford H. Patridge, Newark, all of N.Y.

[73] Assignee: Pactiv Corporation, Lake Forest, Ill.

[21] Appl. No.: 09/501,961

[22] Filed: Feb. 10, 2000

Related U.S. Application Data

[62] Division of application No. 09/325,950, Jun. 4, 1999, Pat. No. 6,089,753.

[51] Int. Cl.[7] ..... B31B 1/64; B31B 49/04

[52] U.S. Cl. ..... 493/198; 493/243; 493/267; 493/342; 493/413; 493/430; 383/8; 383/37; 206/390; 206/554

[58] Field of Search ..... 493/413, 430, 493/433, 198, 194, 195, 243, 255, 267, 342, 926; 383/8, 37; 206/390, 554

[56] References Cited

U.S. PATENT DOCUMENTS

| | | | |
|---|---|---|---|
| 3,482,761 | 12/1969 | Suominen et al. | 383/8 |
| 3,942,713 | 3/1976 | Olson et al. | 229/62 |
| 4,232,589 | 11/1980 | Ernst | 493/223 |
| 4,759,742 | 7/1988 | Achelpohl | 383/37 X |
| 4,790,437 | 12/1988 | Pistner | 383/37 X |
| 4,846,349 | 7/1989 | Galimberti | 383/8 X |
| 5,195,683 | 3/1993 | Gaetano | 229/72 |
| 5,573,489 | 11/1996 | Letendre et al. | 493/194 |
| 5,890,810 | 4/1999 | Barlow | 383/8 X |
| 6,059,707 | 5/2000 | Belias et al. | 493/198 |
| 6,089,753 | 7/2000 | Belias et al. | 383/8 |

*Primary Examiner*—Peter Vo
*Assistant Examiner*—Hemant M. Desai
*Attorney, Agent, or Firm*—Jenkens & Gilchrist

[57] ABSTRACT

A method of forming a plurality of easy to open handle bags is provided. The method includes providing a flattened tube of thermoplastic material oriented in a generally longitudinal direction. The flattened tube has a first longitudinal side edge, a second longitudinal side edge, and a transverse heat seal. The tube has first, second, and third sections. The second section is disposed between the first and third sections. The first section is joined to the second section along a generally longitudinal first fold line. The second section is joined to the third section along a generally longitudinal second fold line. A generally rectangular hole is cut through the second section. The generally rectangular hole has a top edge and a bottom edge. The generally rectangular hole is contained transversely between the first and second fold lines. The tube is then Z-folded such that the second section is folded over the third section along the second fold line and the first section is folded over the folded second and third sections along the first fold line. As a result, the first, second, and third sections overlap one another. A line of weakness is formed adjacent the heat seal. The overlapped first, second, and third sections are cut along a first cut line that intersects the line of weakness, extends therefrom past the bottom edge of the generally rectangular hole, and intersects the first fold line. The overlapped first, second, and third sections are also cut along a second cut line that intersects the line of weakness, extends therefrom past the bottom edge of the generally rectangular hole, and intersects the second fold line.

49 Claims, 6 Drawing Sheets

EASY TO OPEN HANDLE BAG AND METHOD OF MAKING THE SAME

This is a divisional of application Ser. No. 09/325,950, filed Jun. 4, 1999 now U.S. Pat. No. 6,089,753.

FIELD OF THE INVENTION

The present invention relates generally to the field of thermoplastic bags. More particularly, it concerns thermoplastic handle bags having a T-shirt configuration.

BACKGROUND OF THE INVENTION

For many years, thermoplastic bags have been widely used for a number of household and industrial purposes. Many bags have a simple rectangular structure comprising two layers of thermoplastic film heat sealed at the bag bottom, folded sides and an open top. This simple structure has been adapted to form a wide variety of sizes and configurations that vary with the intended uses of the bags.

In recent years, bag manufacturers have developed new types of thermoplastic bags such as, for example, draw tape bags, handle bags, and bags with protruding top edges. These different bag types provide the user with different advantages such as being able to easily close, tie and/or identify a bag. However, the easy to open, use and close handle bags have traditionally required expensive and complicated manufacturing procedures. Furthermore, handle bag manufacturers have experienced cost reduction pressure from other products and, as a result of their cost reduction efforts, new product configurations have been developed. These new handle bag configurations have decreased the manufacturing costs of the product but have also made the resulting bags more difficult to open and use.

For example, one existing low cost handle bag configuration is produced by starting with a thin thermoplastic film tube that is transversely heat sealed to form individual bags. The tube is then double folded. Specifically, the edges of tube are longitudinally folded inward so that the edges are adjacent to the middle of the bag. The tube is then folded again about its middle thereby forming four overlapped bag sections comprising eight layers of thermoplastic material. A corner of the bag is then removed to form the handles and bag mouth. Such a manufacturing process is described and illustrated in U.S. Pat. No. 4,790,467.

However, the above described manufacturing process makes the resulting handle bag difficult and time consuming to open and use. A user must first unfold the second middle fold and then the first quarter folds in sequence before being able to open the bag. In addition, this method tends to trap air between the folded tube sections which further complicates the manufacturing process and reduces efficiency.

Consequently, these deficiencies have created a need for an inexpensive and efficient method of manufacturing handle bags that are easy to open, use and close.

SUMMARY OF THE INVENTION

A method of forming a plurality of easy to open handle bags is provided. The method includes providing a flattened tube of thermoplastic material oriented in a generally longitudinal direction. The tube has first, second, and third sections. The second section is disposed between the first and third sections. A generally rectangular hole is cut through the second section. The tube is then Z-folded such that the first, second, and third sections overlap one another. The Z-folded tube has a first side and a second side. A first portion of the overlapped first, second, and third sections is cut away adjacent the first side of the Z-folded tube. A second portion of the overlapped first, second, and third sections is cut away adjacent the second side of the Z-folded tube so as to form the handle bag.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DESCRIPTION OF ILLUSTRATIVE EMBODIMENTS

Figure 1:
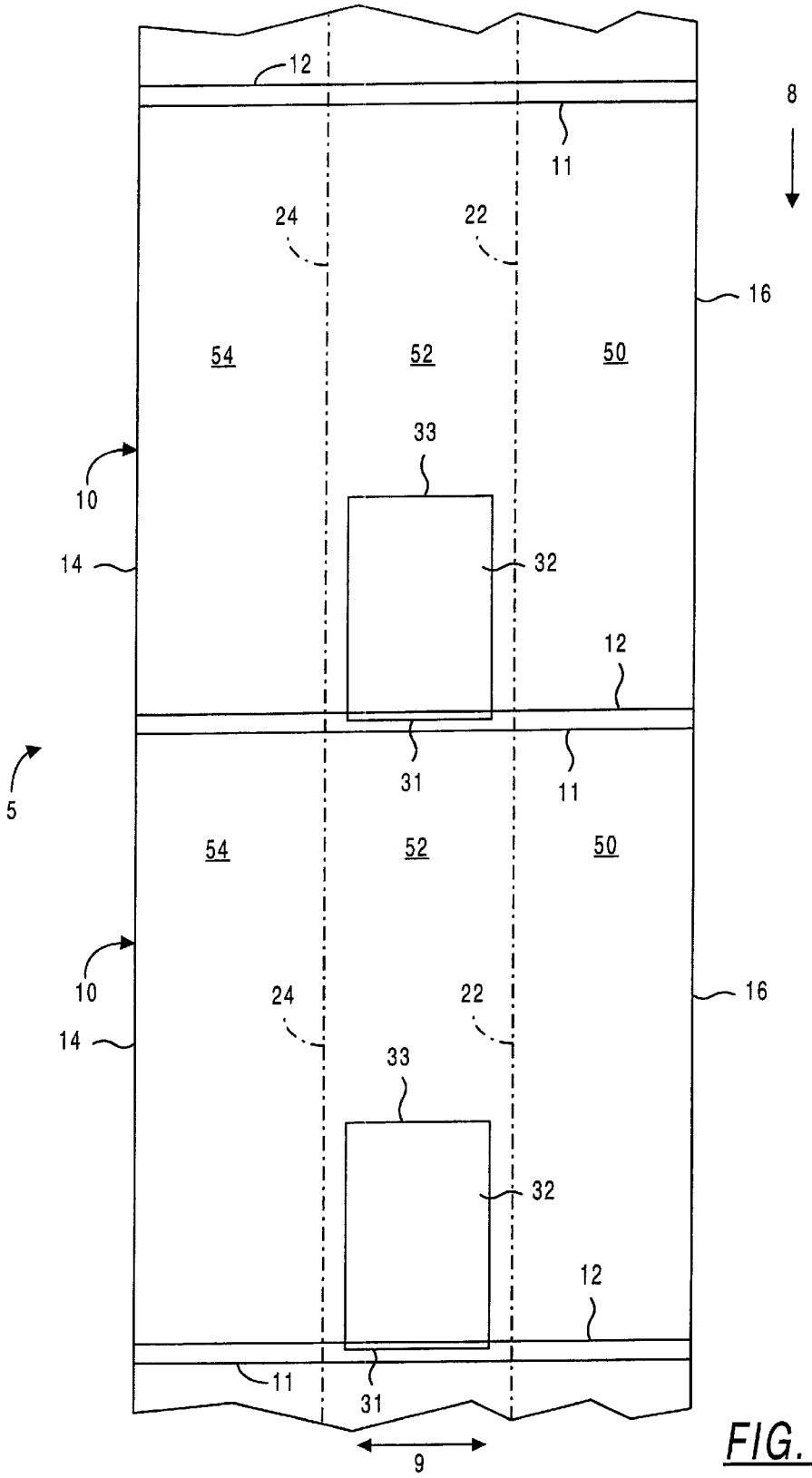
FIG. 1 is a plan view of a collapsed thermoplastic tube.

Referring now to the drawings, and more particularly to FIG. 1, there is shown a collapsed thermoplastic tube 5 traveling in a longitudinal direction 8. The collapsed tube 5 includes an opposing top and bottom layer of thermoplastic film. Each opposing layer may comprise one or more layers of thermoplastic material. The transverse direction 9 is generally perpendicular to the longitudinal direction 8 in which the thermoplastic tube 5 moves. The thermoplastic material used can be any thermoplastic material well known to one of ordinary skill in the art and as more specifically detailed herein below. The tube 5 includes a plurality of interconnected bag forming segments 10. Each bag forming segment 10 includes a pair of opposing longitudinal side edges 14 and 16. Adjacent bag forming segments 10 are separated from each other by transverse heat seals 11 and 12. Each bag forming segment 10 comprises a first, second and third section 50, 52 and 54, respectively. The second section 52 is disposed between the first section 50 and the third section 54. The first section 50 is joined to the second section 52 along a generally longitudinal first fold line 22. The second section 52 is joined to the third section 54 along a generally longitudinal second fold line 24.

The method of forming a plurality of interconnected handle bags begins by forming a pair of transverse heat seals 11 and 12 for each bag forming segment 10 at about bag-length distances apart. To form the heat seals 11 and 12, the tube 5 travels through a sealing station where the transverse heat seals 11 and 12 are formed across the tube 5. The opposing thermoplastic layers of the tube 5 are thermally fused to each other along the heat seals 11 and 12. Alternatively, one broad heat seal may replace the heat seals 11 and 12. This broad heat seal may then either be perforated or severed, as described below, to produce the same results described herein.

The method proceeds by cutting a generally rectangular hole 32 through the second section 52. The generally rectangular hole 32 is contained transversely between the first and second fold lines 22 and 24. A top edge 31 of the generally rectangular hole 32 is contained longitudinally between the pair of heat seals 11 and 12. The tube 5 is cut at a first cutting station that includes a cutting instrument, such as a rectangular hole punch, that severs both layers of the tube 5 to form the generally rectangular hole 32. A generally rectangular cut-out corresponding to the generally rectangular hole is then removed.

Figure 2A:
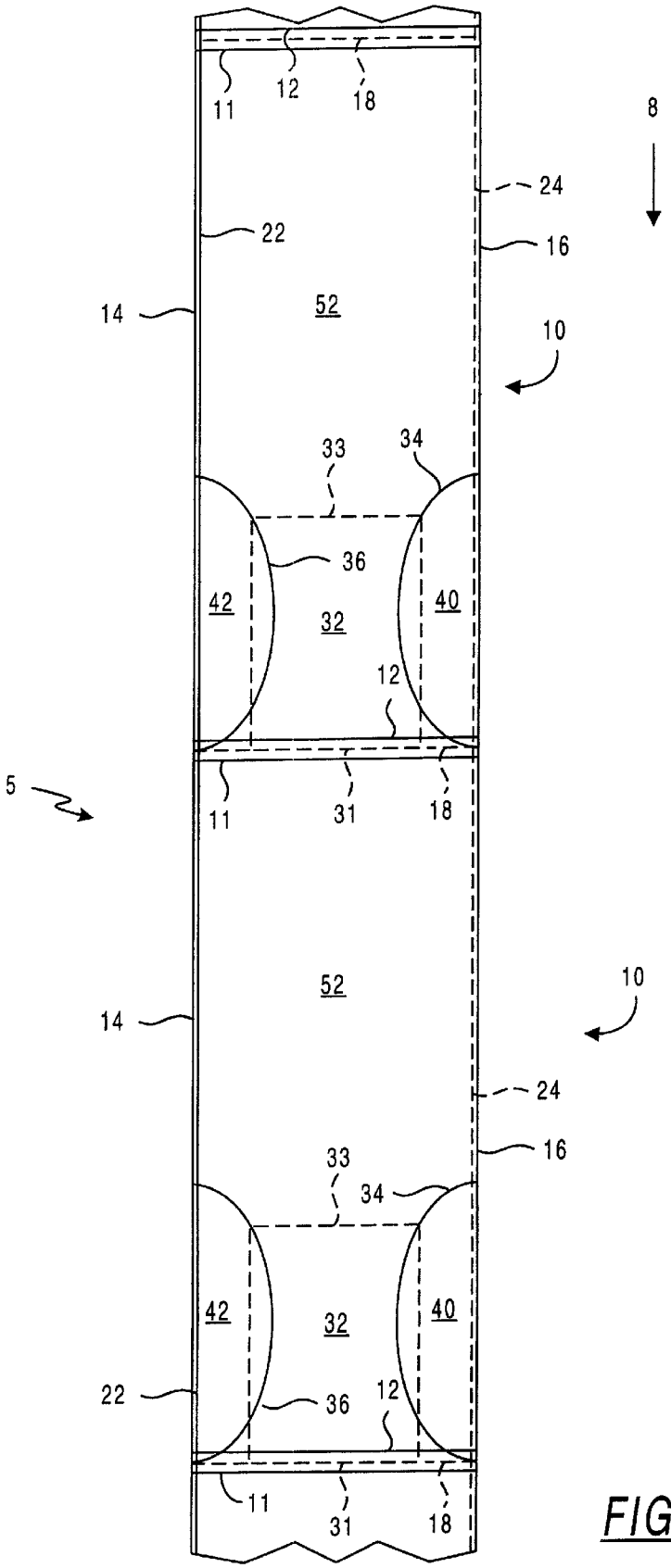
FIG. 2*a* is a plan view of the tube of FIG. 1 after it has been Z-folded in thirds.
Figure 2B:
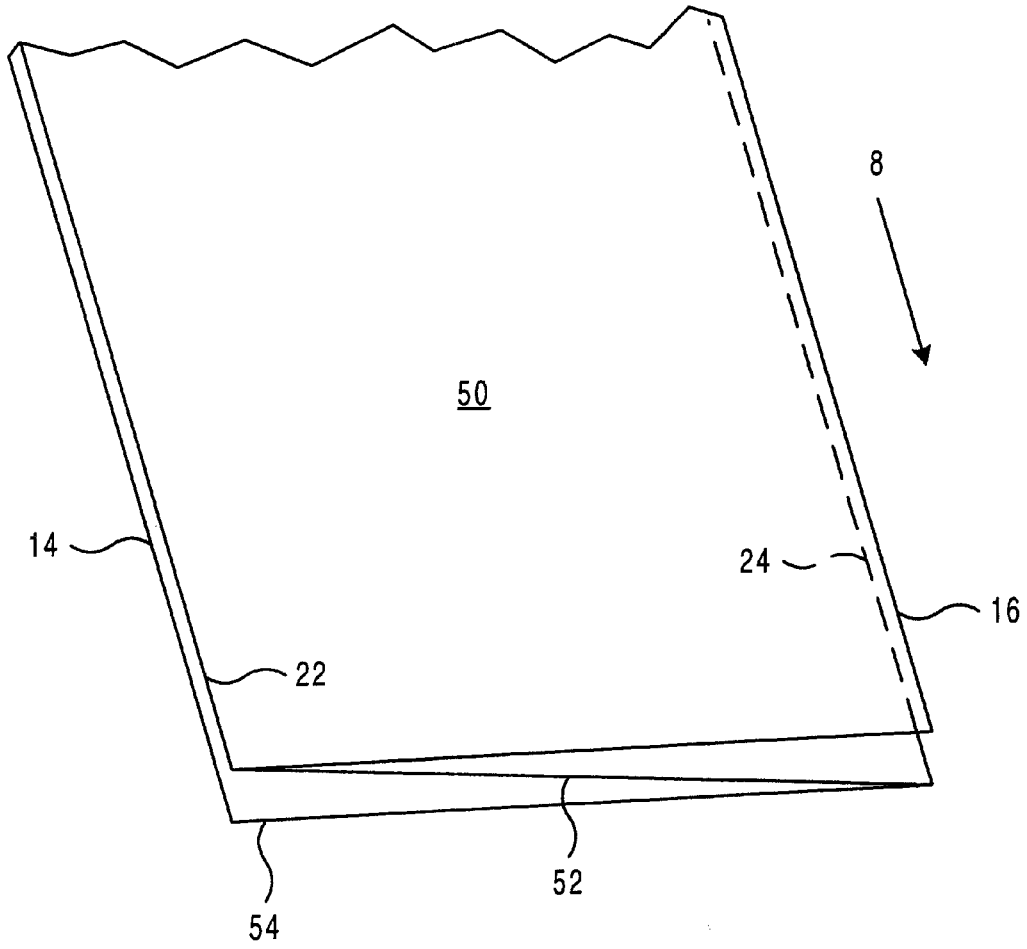
FIG. 2*b* is a perspective view showing the tube of FIG. 1 after the tube is Z-folded.
Figure 3:
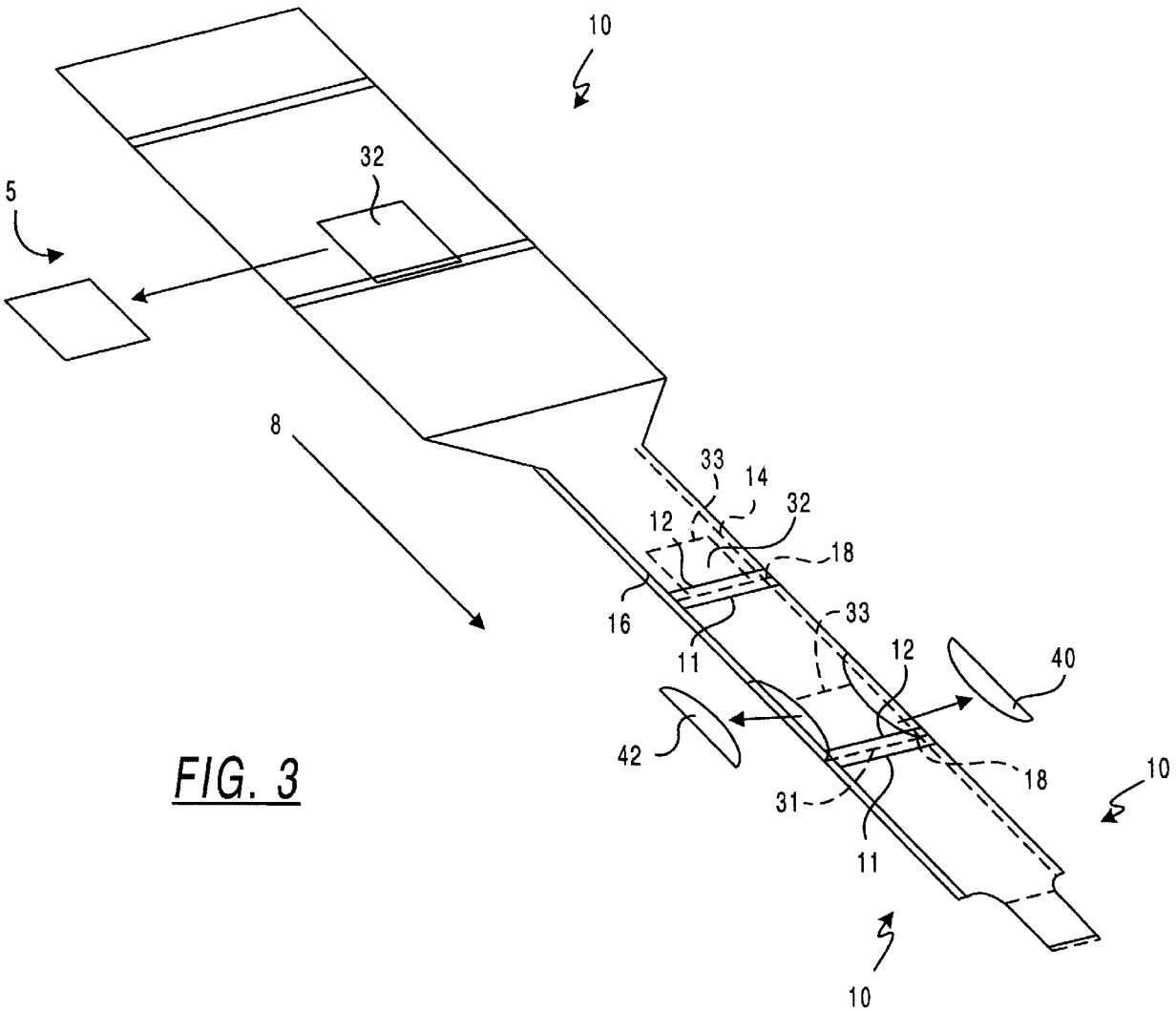
FIG. 3 is a perspective view of the tube of FIG. 1 being Z-folded into the tube of FIG. 2*a*.

Referring now to FIGS. 1, 2*b* and 3, the method continues by Z-folding the tube 5 such that the second section 52 is folded over the third section 54 along the second fold line 24 and the first section 50 is folded over the folded second and third sections 52 and 54 along the first fold line 22. Thus, the first section 50 is disposed above the second 52 and the third section 54, as illustrated in FIG. 2*b* (each section is shown as a single layer for simplicity, each layer actually comprises two layers of thermoplastic film). A top view of the resulting tube 5 is illustrated in FIG. 2*a*.

Each bag forming segment 10 is then weakened between the heat seals 11 and 12 at a line of weakness 18. The transverse lines of weakness 18 are created between the upper heat seal 12 of one bag forming segment 10 and the lower heat seal 11 of an adjacent bag forming segment 10 to form separable bags and to facilitate removal of portions 40 and 42, as described below. The lines of weakness 18 may be in the form of perforations, thinned lines, scored lines, etc. Each transverse line of weakness 18 is generally aligned such that it falls on the top edge 31 of the generally rectangular hole 32.

Referring now to FIGS. 2*a* and 3, in one embodiment, a second cutting station cuts the overlapped first, second, and third sections 50, 52 and 54 along a generally arc shaped first cut line 36 that intersects the line of weakness 18 and the first fold line 22, extends therefrom past the bottom edge 33 of the generally rectangular hole 32, and again intersects the first fold line 22. Next, the second cutting station cuts the overlapped first, second, and third sections 50, 52 and 54 along a generally arc shaped second cut line 34 that intersects the line of weakness 18 and the second fold line 24, extends therefrom past the bottom edge 33 of the generally rectangular hole 32, and again intersects the second fold line 24. Portions 40 and 42 are then removed, as illustrated in FIG. 3, to form a plurality of interconnected handle bags 10. Removed portions 40 and 42 include six layers of thermoplastic film. The outline of the generally rectangular hole 32 is shown in phantom in the bottom part of FIG. 3 because the generally rectangular hole 32 is contained in section 52 which is obstructed in this view by folded over section 50.

Figure 4A:
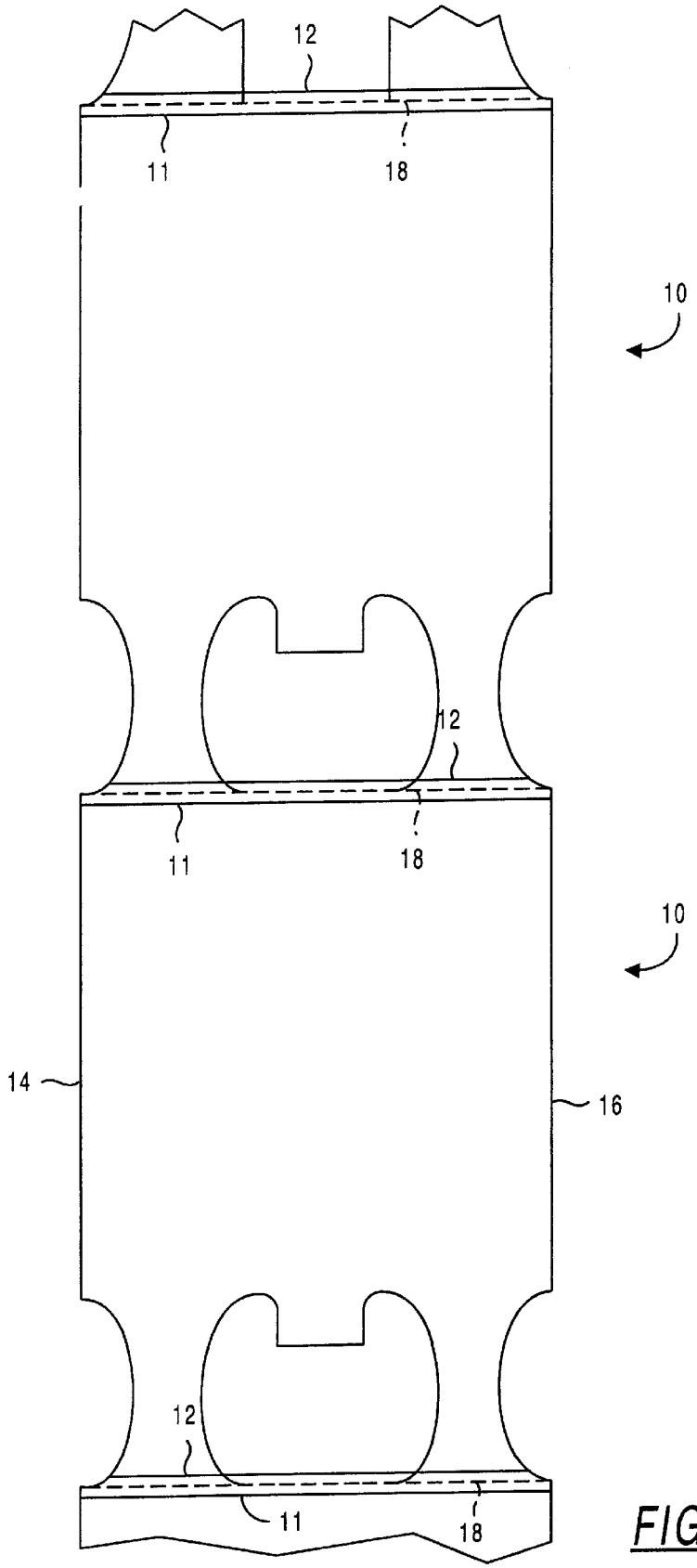
FIGS. 4*a* and 4*b* are plan views of the tube of FIG. 2*a* after it has been unfolded.
Figure 4B:
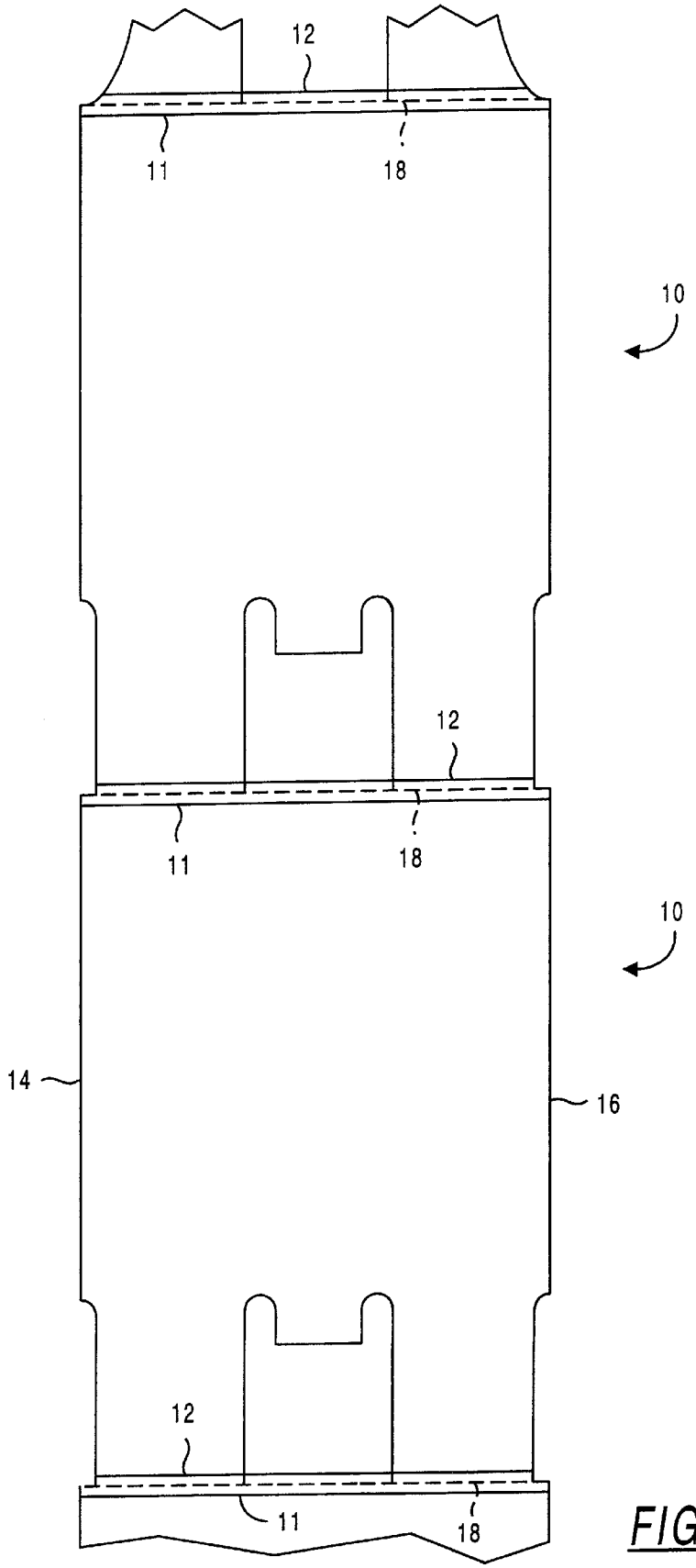

The shape of the removed portions 40 and 42 may vary depending on how the second cutting station cuts the overlapped first, second, and third sections 50, 52 and 54 to form first and second cut lines 36 and 34. Thus, two possibilities of how the plurality of interconnected handle bags 10 will appear when laid flat are illustrated in FIGS. 4*a* and 4*b*, respectively. Other handle shapes are possible as would be apparent to one skilled in the art.

Therefore, the method of the present invention provides a plurality of longitudinally folded and interconnected handle bags 10. In one embodiment, the bags 10 are then wound onto a roll for packaging. In another embodiment, the bags 10 are severed into individual bags, folded transversely and stacked for packaging. In yet another embodiment, each bag 10 is first folded transversely and then severed from the interconnected bags and stacked for packaging. The above methods provide a handle bag that is easy to open, use and close thus saving the user time and preventing frustration.

The thermoplastic materials suitable for the present invention include high density and low density polyethylenes. Particularly preferred is linear low density polyethylene (LLDPE). LLDPE is an ethylenic copolymer formed by copolymerizing ethylene with a minor proportion by weight of an alpha olefin monomer containing 4 to 10 carbon atoms. The use of LLDPE in garbage bags has permitted manufacturers to increase strength, puncture resistance, and tear resistance properties. By way of example, and not intended to limit the scope of the present invention, typical film thicknesses used for bags of the present invention are from about 0.3 mil to about 1.5 mil.

Accordingly, the present invention provides a low cost method of forming handle bags that are easy and less time consuming to open, use and close. The claimed method also involves less folding than prior methods of forming handle bags. Furthermore, the claimed method improves manufacturing efficiency because the open area 32 is trapped between the first and third sections of the tube 5. Thus, the open area 32 does not interfere with downstream processing of the tube 5 because the likelihood of an adjoining portion of the open area 32 getting caught in the processing equipment is greatly reduced. Accordingly, the speed and efficiency of the manufacturing process is increased. Moreover, the Z-folded tube 5 allows air to escape during the folding process. This facilitates increased manufacturing speed and efficiency. In contrast, prior double folded and C-folded methods tended to trap air between the tube sections. In addition, the handle bag resulting from the claimed method is also easier to open and use because to open the bag, the user need only grip the handles and pull them apart. The user need not rotate one wrist while opening the bag as is the case with C-folded bags.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A method of forming an easy to open handle bag, comprising the steps of:

providing a flattened tube of thermoplastic material oriented in a generally longitudinal direction, said flattened tube having a first longitudinal side edge, a second longitudinal side edge, and a transverse heat seal, said tube having first, second, and third sections, said second section being disposed between said first and third sections, said first section being joined to said second section along a generally longitudinal first fold line, said second section being joined to said third section along a generally longitudinal second fold line;

cutting a generally rectangular hole through said second section, said generally rectangular hole having a top edge and a bottom edge, said generally rectangular hole being contained transversely between said first and second fold lines;

folding said second section over said third section along said second fold line;

folding said first section over said folded second and third sections along said first fold line such that said first, second, and third sections overlap one another;

forming a line of weakness adjacent said heat seal;

cutting said overlapped first, second, and third sections along a first cut line that intersects said line of weakness, extends therefrom past said bottom edge of said generally rectangular hole, and intersects said first fold line; and cutting said overlapped first, second, and third sections along a second cut line that intersects said line of weakness, extends therefrom past said bottom edge of said generally rectangular hole, and intersects said second fold line.

2. The method of claim 1, wherein said transverse heat seal includes a lower heat seal and an upper heat seal.

3. The method of claim 2, wherein the step of forming a line of weakness includes locating said line of weakness between adjacent pairs of said upper and lower heat seals.

4. The method of claim 2, wherein said top edge of said generally rectangular hole is contained longitudinally between said upper and lower heat seals.

5. The method of claim 1, further including the step of removing a generally rectangular cut-out formed by said step of cutting a generally rectangular hole, said step of removing being prior to the step of folding said second section over said third section along said second fold line.

6. The method of claim 1, wherein said generally rectangular hole is formed by a rectangular hole punch that severs said tube.

7. The method of claim 1, wherein said first and second cut lines form respective generally parabolic, removable portions.

8. The method of claim 7, wherein said removable portions each comprise six layers of thermoplastic material.

9. The method of claim 1, wherein said first, second and third sections are approximately equal in area.

10. The method of claim 1, wherein said first and second cut lines are generally arc shaped.

11. The method of claim 1, wherein said first and second cut lines create handles for said bag.

12. The method of claim 1, wherein said generally rectangular hole creates an empty gap between said handles.

13. The method of claim 12, wherein said empty gap is formed by removing two layers of thermoplastic material from said second section.

14. The method of claim 1, wherein said first and second cut lines form two respective linear-convex portions that are removable.

15. The method of claim 1, wherein said tube is comprised of two opposing layers of thermoplastic material.

16. The method of claim 1, wherein said first, second and third sections each comprise two layers of thermoplastic material.

17. The method of claim 1, wherein said overlapped first, second and third sections comprise a total of six layers of thermoplastic material.

18. A method of forming an easy to open handle bag, comprising the steps of:

providing a flattened tube of thermoplastic material oriented in a generally longitudinal direction, said tube having first, second, and third sections, said second section being disposed between said first and third sections;

cutting a generally rectangular hole through said second section;

Z-folding said tube such that said first, second, and third sections overlap one another, said Z-folded tube having a first side and a second side;

cutting away a first portion of said overlapped first, second, and third sections adjacent said first side of said Z-folded tube; and cutting away a second portion of said overlapped first, second, and third sections adjacent said second side of said Z-folded tube so as to form said handle bag.

19. The method of claim 18, further including said step of forming a transverse heat seal.

20. The method of claim 19, wherein said transverse heat seal includes a lower heat seal and an upper heat seal.

21. The method of claim 20, further including said step of forming a line of weakness between adjacent pairs of said upper and lower heat seals.

22. The method of claim 20, wherein said generally rectangular hole includes a top edge that is contained longitudinally between said upper and lower heat seals.

23. The method of claim 18, further including the step of removing a generally rectangular cut-out formed by said step of cutting a generally rectangular hole, said step of removing being prior to the step of Z-folding.

24. The method of claim 18, wherein said generally rectangular hole is formed by a rectangular hole punch that severs said tube.

25. The method of claim 18, wherein said first and second portions are generally parabolic shaped portions.

26. The method of claim 18, wherein said first and second portions each comprise six layers of thermoplastic material.

27. The method of claim 18, wherein said first, second, and third sections are approximately equal in area.

28. The method of claim 18, wherein said first and second portions are partially generally circular portions that are removable.

29. The method of claim 18, wherein said first and second portions create handles for said bag.

30. The method of claim 29, wherein said generally rectangular hole creates an empty gap between said handles.

31. A method of forming a plurality of interconnected bag segments each having handles, the method comprising the steps of:

providing a flattened tube of thermoplastic material oriented in a generally longitudinal direction and comprised of said plurality of interconnected bag segments, each bag segment having a first longitudinal side edge, a second longitudinal side edge, and a transverse heat seal, said tube having first, second, and third sections, said second section being disposed between said first and third sections, said first section being joined to said second section along a generally longitudinal first fold line, said second section being joined to said third section along a generally longitudinal second fold line;

cutting a generally rectangular hole through said second section, said generally rectangular hole having a top edge and a bottom edge, said generally rectangular hole being contained transversely between said first and second fold lines;

folding said second section over said third section along said second fold line;

folding said first section over said folded second and third sections along said first fold line such that said first, second, and third sections overlap one another;

forming a line of weakness adjacent said heat seal;

cutting said overlapped first, second, and third sections along a first cut line that intersects said line of weakness, extends therefrom past said bottom edge of said generally rectangular hole, and intersects said first fold line;

cutting said overlapped first, second, and third sections along a second cut line that intersects said line of weakness, extends therefrom past said bottom edge of said generally rectangular hole, and intersects said second fold line; and removing portions of said tube formed by said first and second cut lines to provide said bag segments with handles.

32. The method of claim 31, wherein said transverse heat seal includes a lower heat seal and an upper heat seal.

33. The method of claim 32, wherein the step of forming a line of weakness includes locating said line of weakness between adjacent pairs of said upper and lower heat seals.

34. The method of claim 32, wherein said upper and lower heat seals are part of one broad heat seal.

35. The method of claim 32, wherein said top edge of said generally rectangular hole is contained longitudinally between said upper and lower heat seals.

36. The method of claim 31, further including the step of removing a generally rectangular cut-out formed by said step of cutting a generally rectangular hole, said step of removing being prior to the step of folding said second section over said third section along said second fold line.

37. The method of claim 31, further comprising the step of winding said plurality of interconnected bag segments into a roll.

38. The method of claim 31, further comprising the steps of:

separating said plurality of interconnected bag segments;

transversely folding said bag segments; and stacking said folded bag segments for packaging.

39. The method of claim 38, wherein the step of transversely folding said bag segments occurs prior to the step of separating said bag segments.

40. The method of claim 31, wherein said tube is comprised of opposing top and bottom layers of thermoplastic material.

41. The method of claim 31, wherein said generally rectangular hole is formed by a rectangular hole punch that severs said tube.

42. The method of claim 31, wherein said first and second cut lines form respective generally parabolic, removable portions.

43. The method of claim 42, wherein said removable portions comprise six layers of thermoplastic material.

44. The method of claim 31, wherein said first, second, and third sections are approximately equal in area.

45. The method of claim 31, wherein said first and second cut lines are generally arc shaped.

46. The method of claim 31, wherein said first and second cut lines form two respective partially generally circular portions that are removable.

47. The method of claim 31, wherein said first and second cut lines create a pair of handles for each of said plurality of interconnected bag segments.

48. The method of claim 47, wherein said generally rectangular hole creates an empty gap between said handles.

49. The method of claim 48, wherein said empty gap is formed by said removal of two layers of thermoplastic material from said second section.

* * * * *